US005322426A

United States Patent [19]

Kolb

[11] Patent Number: 5,322,426

[45] Date of Patent: Jun. 21, 1994

[54] DISPLACEMENT MACHINE SPIRAL SHAPED STRIP WITH DIFFERENT CURVATURES

[75] Inventor: Roland Kolb, Regensdorf, Switzerland

[73] Assignee: Aginfor Ag Fur Industrielle Forschung, Wettingen, Switzerland

[21] Appl. No.: 985,652

[22] Filed: Dec. 7, 1992

[30] Foreign Application Priority Data

Dec. 5, 1991 [CH] Switzerland ..... 3579/91

[51] Int. Cl.[5] ..... F01C 1/04; F04C 18/04

[52] U.S. Cl. ..... 418/55.2; 418/60

[58] Field of Search ..... 418/55.2, 60

[56] References Cited

U.S. PATENT DOCUMENTS 4,715,797 12/1987 Guttinger ..... 418/55.2

4,781,549 11/1988 Caillat ..... 418/55.2

FOREIGN PATENT DOCUMENTS 0321781 6/1989 European Pat. Off. .

2603462 8/1976 Fed. Rep. of Germany .

848889 8/1939 France ..... 418/55.2

*Primary Examiner*—John J. Vrablik

*Attorney, Agent, or Firm*—Oblon, Spivak, McClelland, Maier & Neustadt

[57] ABSTRACT

A displacement machine for compressible mediums exhibits several spiral-shaped conveying spaces, which are disposed in a stationary housing and which span a circumferential angle of approximately 360°. The spiral-shaped displacement bodies, which are assigned to the conveying spaces and which span a circumferential angle of approximately 360°, are held in such a manner on a disk-shaped rotor, driven off-centered with respect to the housing, that during service each of their points effects a circular movement defined by the circumferential walls of the conveying spaces. The predominant reach of both the spirals of the conveying spaces and the displacement bodies extends with a first curvature and their exit-sided end exhibits over an angular range ($\alpha$) of 45° a second curvature that is clearly smaller.

2 Claims, 3 Drawing Sheets

DISPLACEMENT MACHINE SPIRAL SHAPED STRIP WITH DIFFERENT CURVATURES

BACKGROUND OF THE INVENTION

1. Field of the Invention

The invention relates to a displacement machine for compressible mediums with at least one spiral-shaped conveying space, which is disposed in a stationary housing and which spans a circumferential angle of approximately 360°. A spiral-shaped member is assigned to this conveying space, spans a circumferential angle of approximately 360° and is held in such a manner on a disk-shaped rotor, driven off-centered with respect to the housing, that during service each of its points effects a circular movement defined by the circumferential walls of the conveying space, and its curvature with respect to that of the conveying space is dimensioned in such a manner that it almost touches the inner and outer circumferential walls of the conveying space at at least one sealing line that advances continuously during operation.

2. Background of the Invention

Displacement machines of the spiral design are known, for example, from DE-C-26 03 462. A compressor built according to this principle provides an almost pulsation free conveying of the gaseous working medium, which consists of, for example, air or a mixture of air and fuel. It could also be used advantageously for the purpose of charging internal combustion engines. While such a compressor is operating, several possibly crescent-shaped working spaces, which move from the inlet through the displacement chamber to the outlet, are enveloped along the displacement chamber between the spiral-shaped displacement body and the two circumferential walls of the displacement chamber, thus resulting in their volume being continuously decreased and the pressure of the working medium being increased correspondingly. In this machine one proceeds on the assumption that the circumferential angle of the spirals leads to a compressor with internal compression. To this end, a second spiral element having a significantly shorter radius of curvature is attached to produce a spiral extending over 360°.

A machine of the aforementioned kind, in which the spirals span a total circumferential angle of approximately 360°, is known from the EP-A-0 321 781. In these machines, which are used to charge internal combustion engines, it has been demonstrated that a geometrically internal compression of approximately 1 is the optimal value. Thus, the aforementioned second spiral element having a significantly smaller radius of curvature can be dispensed with. These known machines work with a displacement body whose spiral walls are attached on both sides to a central wall. The radially inner region of this central wall exhibits passage openings which enable the air conveyed by the drive-sided part of the spirals to flow into the air-sided section, in order to be withdrawn from the machine. On each side of the central wall there are two telescoped spirals, whose exits are offset by 180°. The conveying spaces arranged in the housing are configured correspondingly. The result is that the clear diameter between the inner walls of the conveying space at the spiral exit is pertinent for the available space. In this available space, however, must be accommodated not only the working medium displaced by the orbiting spirals, but also the drive shaft with the eccentric and the compensating weights.

SUMMARY OF THE INVENTION

It is an object of the invention to solve the problem of providing a displacement machine of the aforementioned kind with enlarged free space between the stationary spiral ends.

The above object is satisfied by the invention in that the predominant reach of both the spirals of the conveying space and the displacement body extends with a first curvature, and their exit-sided end exhibits, over an angular range between approximately 30° to approximately 90°, a second curvature that is substantially smaller.

The advantage of the invention lies in the fact that by optimizing the spiral exit the free cross section of the passage openings in the rotor can be significantly enlarged. At high throughputs the loss in pressure during passage through the openings is reduced by this measure. The consequence is, among other things, that the axial thrust on the displacement body is also reduced, said thrust acting in the direction of the air exit. Thus, the sealing strips are in turn relieved of stress on the faces of the spiral ribs, by way of which the displacement body is braced at the housing in the axial direction. Furthermore, the invention offers the possibility of enlarging the diameter of the main shaft, forming a bearing for the eccentric, and thus making it more rigid, a feature that is of great importance for the loading capacity of the machine.

It is especially expedient that the exit-sided end of the spirals be provided by way of a 45° angle with the curvature that is obviously smaller. With this measure the largest possible free space can be obtained for a spiral machine having a geometric compression ratio of approximately 1.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
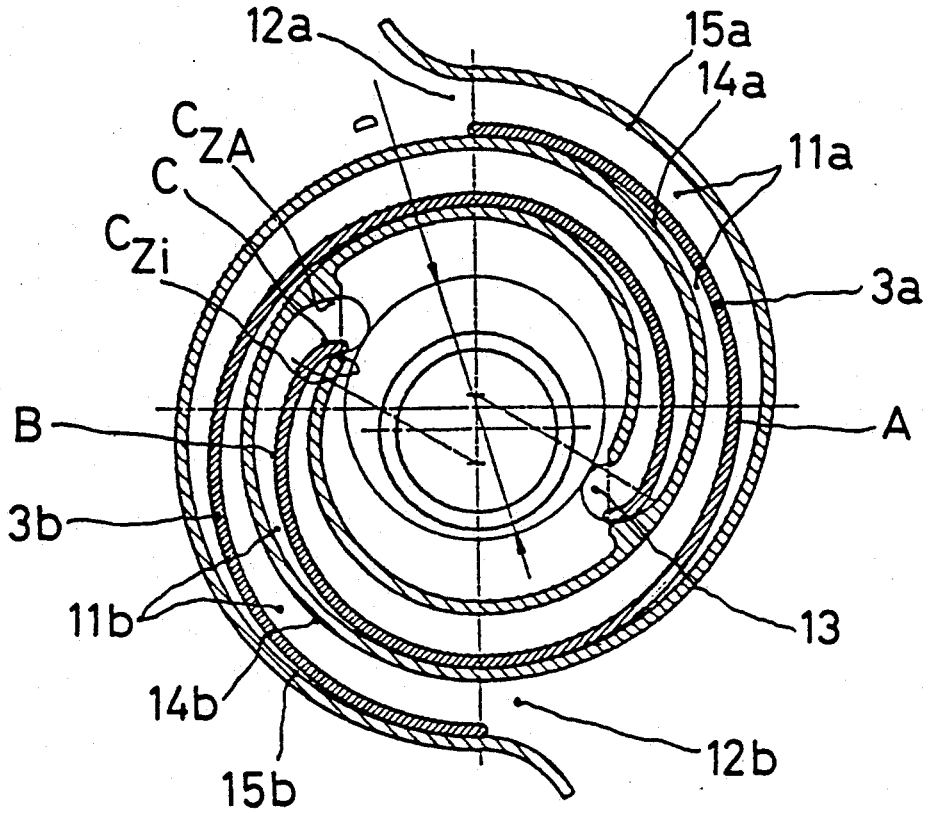
FIG. 1 is a cross sectional view of the drive-side housing section of the displacement machine along line I—I in FIG. 3.
Figure 2:
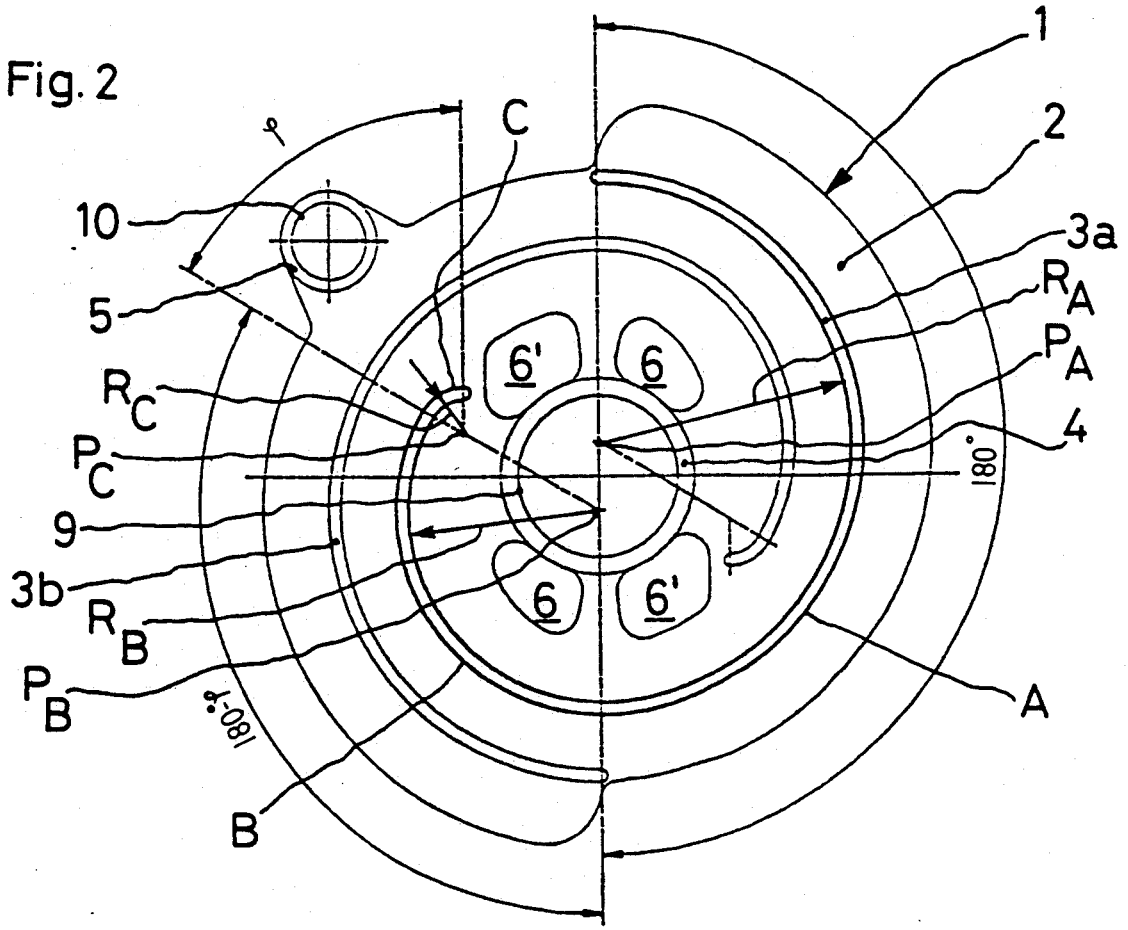
FIG. 2 is a front view of the rotor.

For the purpose of explaining the method by which the compressor functions, which is not the subject matter of the invention, reference is made to the DE-C3-2 603 462 that has already been cited. In the following, only the construction of the machine and process that are necessary for understanding are described briefly. For the sake of a better overview FIG. 2 shows the rotor alone; FIG. 1 shows only the conveying walls and the inserted displacement body. Not shown in FIG. 1 are the remaining cut elements such as housing, guide shaft, drive shaft, etc.

Figure 3:
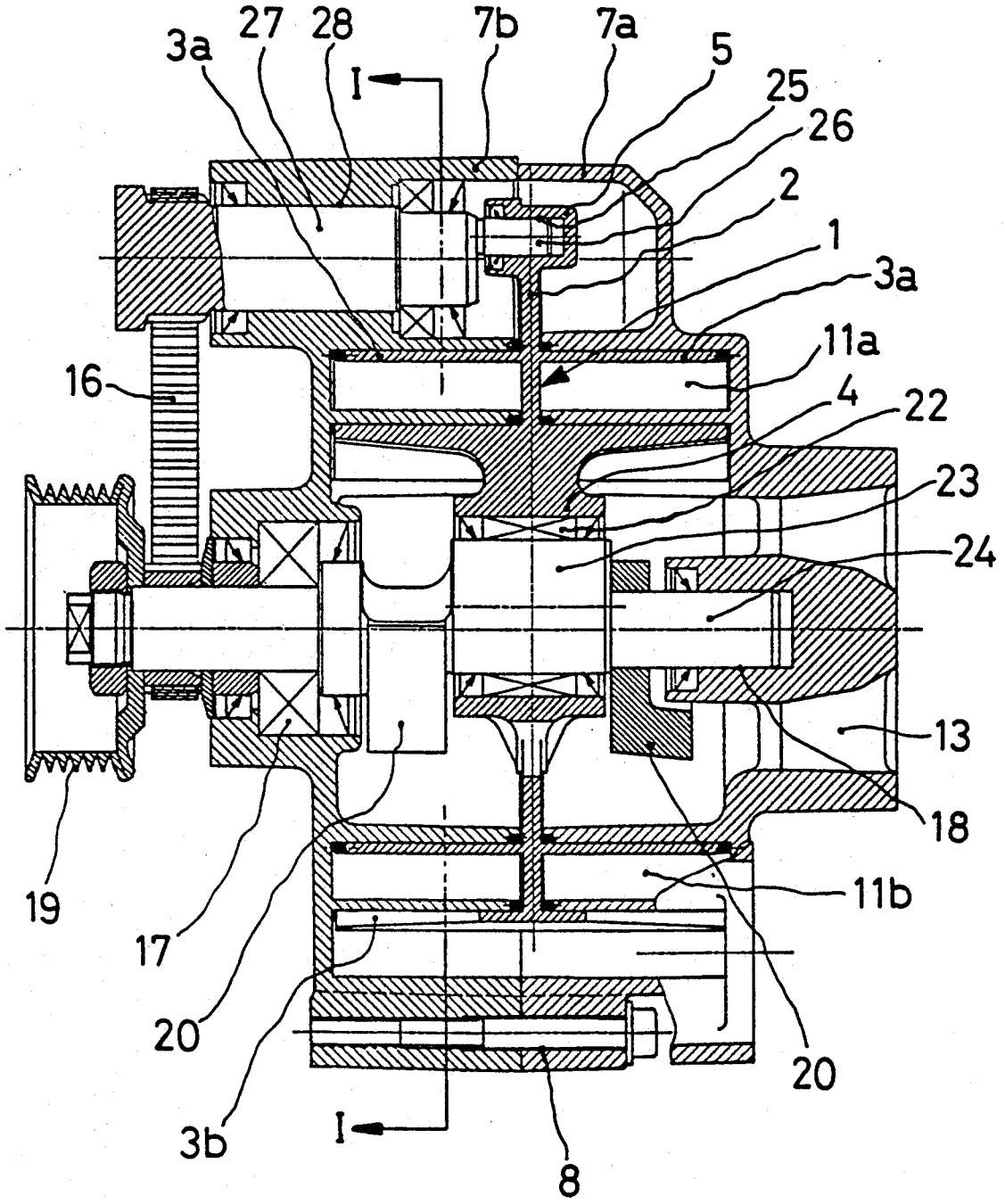
FIG. 3 is a longitudinal view of the displacement machine.

The rotor or displacement body of the machine is denoted as 1. Two spiral-shaped strips 3*a*, 3*b* that are offset by 180° are attached to both sides of the disk 2. Strips 3*a*, 3*b* are held perpendicularly on the disk 2. In the example shown, the spirals themselves comprise several adjoining circular arcs. A hub 4 of the disk 2 is mounted to the eccentric disk 23 via a roller bearing 22 (FIG. 3). The disk 23 is in turn a part of the main shaft 24.

An eye 5, which is arranged radially outside the strips 3*a*, 3*b*, has a guide bearing 25 which is slipped on an eccentric bolt 26 which is a part of a guide shaft 27. The spiral end has four passage windows 6, 6' in the disk so that the medium can flow from one side of the disk to the other in order to be drawn off in a central outlet 13 (FIG. 3) arranged on only one side.

The machine housing comprises two halves 7*a*, 7*b* connected together by way of attachment eyes 8 (FIG. 3) in order to receive threaded joints. Two conveying spaces 11*a* and 11*b* are offset by 180° and are machined like spiral-shaped slots into the two halves of the housing. They extend from one inlet each 12*a*, 12*b*, which is arranged on the outer circumference of the spiral in the housing, to an outlet 13 which is provided within the housing and is common to both conveying spaces. They have essentially parallel cylindrical walls 14*a*, 14*b*, 15*a*, 15*b*, which are spaced equidistant apart and, like the strips of the disk 2, enclose a spiral of 360°. Between these cylindrical walls extend the strips 3*a*, 3*b*, whose curvature is dimensioned in such a manner that the strips almost touch the inner and outer cylindrical walls of the housing at several points, for example at two points simultaneously.

The two spaced eccentric arrangements 23, 24, and 26, 27 respectively provide for the drive and guiding of the rotor 1. The main shaft 24 is mounted in a roller bearing 17 mounted within part 9 and a sliding bearing 18. On its end projecting beyond the housing half 7*b* the shaft is provided with a V-belt pulley 19 for the drive. Counterweights 20 are attached to the shaft in order to compensate for the force due to inertia induced during the eccentric drive of the rotor. The guide shaft 27 is put within the housing half 7*b* in a sliding bearing 28 in part 10.

In order to obtain a definite guide of the rotor at the dead point positions, the two eccentric arrangements are synchronized conformally. This is done by way of a toothed belt drive 16. When in service, the double eccentric drive provides that all of the points of the rotor disk and thus also all of the points of both strips 3*a*, 3*b* effect a circular displacement movement. As a consequence of the strips 3*a*, 3*b* approaching repeatedly and alternately the inner and outer cylindrical walls of the related conveying chambers, the result is crescent-shaped working spaces, which enclose the working medium and which are displaced during the drive of the rotor disk through the conveying chambers in the direction of the outlet, on both sides of the strips. At the same time the volumes of these working spaces decrease and the pressure of the working medium is correspondingly increased.

According to the invention, the predominate extent of both the spirals of the conveying spaces 11*a*, 11*b* and the displacement body 1–4, all of which span a circumferential angle of 360° in total, extends with a first curvature. In the present example, this first curvature section extends over an angle of 315° starting from the inlet-sided end of the spirals. This first section comprises two circular arcs A and B, where its starting part A extends over 180° and the final part B of smaller radius than the radius of part A extends over 135°. The arcuate center of the starting part A is denoted as $P_A$ for the displacement spiral in FIG. 2, that of the final part is denoted as $P_B$. The related radii of curvature are denoted as $R_A$ and $R_B$.

On the exit-sided end the curvature of the second section C extends over a residual angle of 45° with a significantly smaller radius of curvature. These two sections are also circular arcs, whose arcuate center is denoted as Pc and whose radius of curvature is denoted as Rc.

The cylindrical walls of the conveying spaces are adapted in accordance with this displacement shape. In the example chosen, the second section $C_{ZA}$ of the outer cylindrical wall can be clearly recognized in FIG. 1. In contrast, the second section $C_{Zi}$ of the inner cylindrical wall is not so clearly recognizable. It involves here the usual rounding off of the wall at the spiral end, where the radius of the rounding off corresponds to half of the wall thickness. From a fabrication point of view, the chosen configuration is advantageous because no special operations have to be performed for the inner cylindrical wall.

The effects of the present measure are explained with reference to the graphs in FIGS. 4–9. The shortening angle $\alpha$ is plotted on the abscissa of these graphs. The shortening angle is the angular range in which the two sections of the spiral have the significantly smaller radius of curvature. The effects for a shortening section in a range between 0° and 180° were investigated. The latter value would mean that the first section of the spirals would comprise only one circular arc. The second part would have the significantly smaller radius Rc and would extend over 180°.

Figure 4:
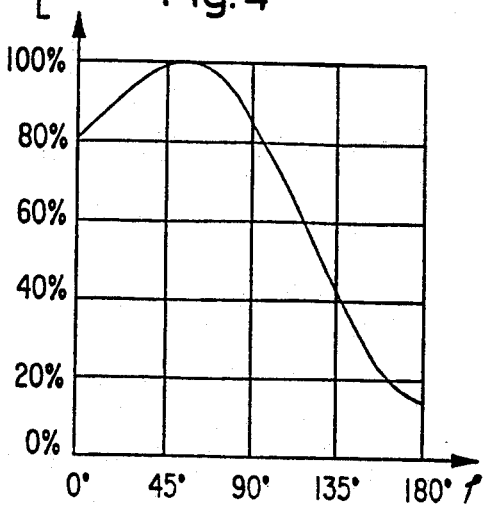
FIG. 4 is a graph of the service life of the main eccentric bearing (needle bearing) as a function of the shortening angle.
Figure 5:
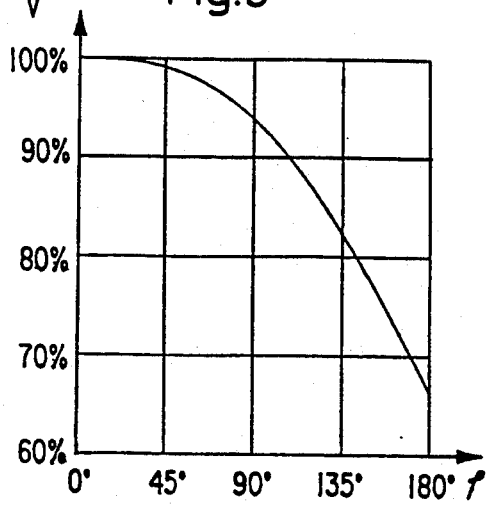
FIG. 5 is a graph of the stroke volume as a function of the shortening angle.

The service life L of the main eccentric bearing 17 is plotted on the ordinate of FIG. 4. In so doing, it was assumed that it involves a needle bearing and the machine is designed for a constant maximum volume flow. By shortening the spiral by the shortening angle, the orbiting mass of the rotor 1 becomes less and thus puts less of a load on the bearing at constant speed. According to the graph it is obvious that, compared to the starting case, i.e., a 360° spiral without the inventive step, each shortening in the region between 0° and 100° increases the service life. The ensuing drop is caused by the increase in speed that becomes necessary with additional shortening.

Figure 6:
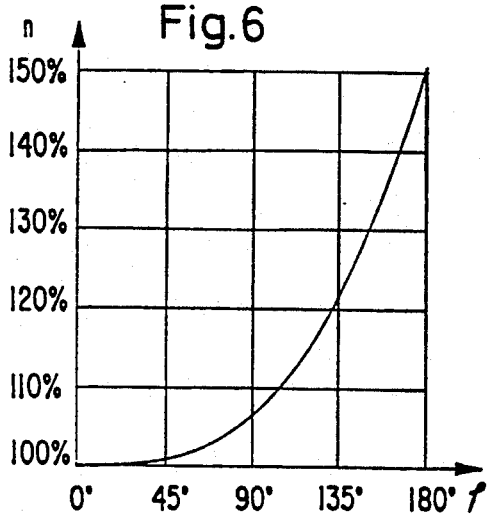
FIG. 6 is a graph of the speed as a function of the shortening angle.

The result of shortening the spiral is naturally a decrease in the maximum intake volume that can be enclosed in the conveying spaces. This situation is evident from FIG. 5 where on the ordinate the stroke volume V is shown. It is obvious that when the spiral is shortened by 90°, only approximately 95% of the original volume is still conveyed. If this original volume is to be maintained, it must be compensated for by increasing the circular speed of the rotor. The resulting necessary increase in speed of the main shaft 24 is shown in FIG. 6, where the speed n is plotted on the ordinate.

Figure 7:
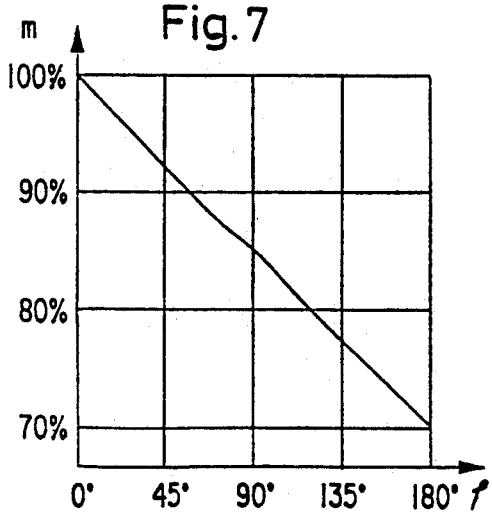
FIG. 7 is a graph of the mass of the displacement as a function of the shortening angle.

In FIG. 7 the displacement mass m is plotted on the ordinate. Here a cross comparison with FIGS. 6 and 4 shows that, starting from a ten percent increase in the speed, the speed begins to have a dominating influence on the service life of the roller bearing despite a noticeable decrease in the mass.

Figure 8:
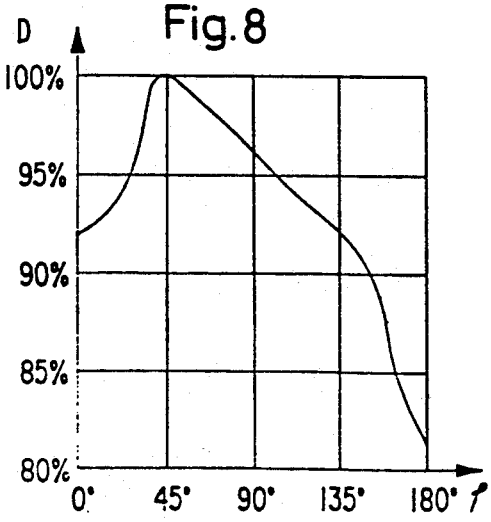
FIG. 8 is a graph of the interior as a function of the shortening angle.

The available interior space D (FIG. 8) between the spiral ends is plotted in percentages on the ordinate of FIG. 8. It is obvious that, compared to the starting case, space can be clearly obtained by shortening over a wide angular range.

Figure 9:
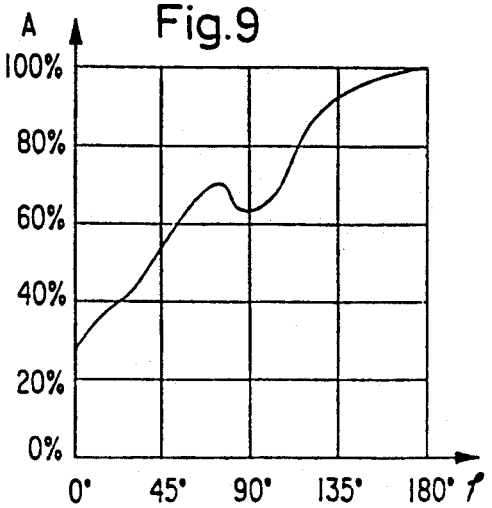
FIG. 9 is a graph of the passage cross section as a function of the shortening angle.

Finally FIG. 9 shows the dependency of the cross section A of the passage window in the rotor. The non-uniformity in the angular range of 90° stems from the arrangement of spokes between the windows, said arrangement necessitated by the design and stability. It has been demonstrated that the shortening angle of 45° makes it possible to arrange, besides the conventional passage windows 6, additional passage windows 6' in the rotor (FIG. 2) lying substantially on a line of extension of the first curvature arcs A and B and thus to almost double the flow area.

The result of the above is that a shortening angle ranging from 30° to 90° leads to the desired result and that the shortening angle of 45°, described and shown by way of an example, is especially advantageous.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A displacement machine for compressible media, comprising:

a stationary housing having a wall, tow inlets and an outlet;

a displacement body in said housing, said displacement body comprising a disk having at least two strips spanning a circumferential angle of about 360° on each of two opposite sides thereof, wherein said strips define at least two spiral shaped conveying spaces spanning a circumferential angle of about 360° on each of the two opposite sides of said disk, said disk further having passage windows adjacent a radially inner end thereof; and means for eccentrically driving said displacement body such that said displacement body effects a circular movement and the at least one strip forms a sealing line with the housing wall, the sealing line between the at least one strip and the housing wall advancing continuously toward said outlet, said displacement body having a central hub for said driving means positioned adjacent said windows, wherein said strip and said wall each define a first curvature having at least first and second radii, the second radius being smaller than the first radius by a certain value, and a second curvature which is at the radially inner end of said respective strip and adjacent said windows, said second curvature having a radius smaller than said second radius of said fist curvature by a value substantially greater than said first value, and having a circumferential angular range of 30°–90°, said passage windows lying substantially on a line of extension of said first curvature.

2. The machine of claim 1 wherein said second curvature has a circumferential angle of 45°.

* * * * *